US010225509B1

(12) United States Patent
Nasca

(10) Patent No.: US 10,225,509 B1
(45) Date of Patent: Mar. 5, 2019

(54) DISPLAY SCREEN MANUFACTURING METHOD

(71) Applicant: Ideum, Inc., Corrales, NM (US)

(72) Inventor: Thomas Nasca, Corrales, NM (US)

(73) Assignee: Ideum, Inc., Corrales, NM (US)

( * ) Notice: Subject to any disclaimer, the term of this patent is extended or adjusted under 35 U.S.C. 154(b) by 114 days.

(21) Appl. No.: 15/285,282

(22) Filed: Oct. 4, 2016

(51) Int. Cl.

| | |
|---|---|
| ***H04N 5/655*** | (2006.01) |
| ***B22D 17/00*** | (2006.01) |
| ***B22D 21/00*** | (2006.01) |
| ***B23K 26/382*** | (2014.01) |
| ***B21C 23/00*** | (2006.01) |
| *G06F 3/041* | (2006.01) |

(52) U.S. Cl.
CPC ..... *H04N 5/655* (2013.01); *B21C 23/00* (2013.01); *B22D 17/00* (2013.01); *B22D 21/007* (2013.01); *B23K 26/382* (2015.10); *G06F 3/041* (2013.01); *G06F 2203/04103* (2013.01); *G06F 2203/04104* (2013.01)

(58) Field of Classification Search
CPC ..... H04N 7/18
USPC ..... 348/836–843
See application file for complete search history.

(56) References Cited

U.S. PATENT DOCUMENTS

| | | | | |
|---|---|---|---|---|
| 3,736,684 | A | 6/1973 | Grad | |
| 4,498,255 | A | 2/1985 | Heard | |
| 6,688,518 | B1 | 2/2004 | Valencia et al. | |
| 2009/0086420 | A1 | 4/2009 | Stockham et al. | |
| 2009/0109352 | A1* | 4/2009 | Lewis | B60R 11/0235 348/837 |
| 2011/0176860 | A1 | 7/2011 | Lin | |

* cited by examiner

*Primary Examiner* — Anand S Rao
(74) *Attorney, Agent, or Firm* — Justin R. Jackson; Deborah A. Peacock; Peacock Law P.C.

(57) ABSTRACT

A method of manufacturing display screens/display screen enclosures (and concomitant display screens/display screen enclosures thus produced) comprising extruding metal to create metal extrusion profiles of the display screen enclosures, casting metal to create metal castings for corners of the display screen enclosures, joining the metal castings to the metal extrusion profiles together forming a frame, and fabricating a sheet metal back panel for structural rigidity and to provide a mounting surface within the frame.

20 Claims, 5 Drawing Sheets

Detail A

Detail B

DISPLAY SCREEN MANUFACTURING METHOD

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF PARTIES TO A JOINT RESEARCH AGREEMENT

Not Applicable.

INCORPORATION BY REFERENCE OF MATERIAL SUBMITTED ON A COMPACT DISC

Not Applicable.

STATEMENT REGARDING PRIOR DISCLOSURES BY THE INVENTOR OR A JOINT INVENTOR

Not Applicable.

COPYRIGHTED MATERIAL

Not Applicable.

BACKGROUND OF THE INVENTION

Field of the Invention (Technical Field)

The present invention relates to a method of manufacturing display screens, particularly those used in multi-touch applications.

Description of Related Art Including Information Disclosed Under 37 C.F.R. §§ 1.97 and 1.98

Large screen displays, including multi-touch screens made by Ideum™, typically comprise a hardened aluminum casing that encapsulates a flat-panel television, a touch sensor bonded to strengthened glass, and other associated components. These encapsulated components are designed, manufactured, and sold by various companies. Due to the fast-moving nature of today's technology companies, these components change design and specification frequently. These changes often require redesigning of the aluminum enclosure. With each component change, one must design, test, prototype, and arrange manufacturing for the metal casing that encapsulates the internal hardware components. These frequent redesigns are both a financial and time burden and ultimately increase cost and lead times for customers.

Furthermore, due to the fast-moving nature of the technology industry, certain display sizes fall into and out of popularity. When one pursues offering a new display size, this lengthy process of design, testing, prototyping, and arranging for manufacturing also applies.

BRIEF SUMMARY OF THE INVENTION

The present invention is of a method of manufacturing display screen enclosures (and concomitant display screen enclosures thus produced), comprising the steps of: extruding metal to create metal extrusion profiles of the display screen enclosures; casting metal to create metal castings for corners of the display screen enclosures; joining the metal castings to the metal extrusion profiles together forming a frame; and fabricating a sheet metal back panel for structural rigidity and to provide a mounting surface within the frame. In certain embodiments, the cast metal comprises a metal alloy, with casting comprising: heating the metal alloy beyond its melting point, wherein said heating produces a liquid metal; pouring or mechanically forcing said liquid metal into a tool or a mold, wherein the tool or mold is a negative of an intended form; cooling the liquid metal inside of the tool or mold until it is a solidified metal; disassembling the tool or mold around the solidified metal; adjusting the solidified metal to meet predetermined specifications; and repeating to create a plurality of substantially similar metal castings. In certain embodiments, the extruded metal comprises aluminum, with extruding producing long lengths of material with a uniform profile, and preferably further comprising: preheating raw aluminum ingots to a temperature below the melting point of the raw aluminum ingots; preheating a tool die with a hole to the same temperature; pressing the raw aluminum ingots into the tool die with a predetermined force, wherein temperature and pressure makes the raw aluminum ingots malleable; forcing the raw aluminum ingots through the hole of the tool die; producing the profile in a length of aluminum, wherein the profile is a uniform aluminum extrusion profile; adjusting the aluminum until the aluminum extrusion meets predetermined product specifications; and repeating to create a plurality of substantially similar aluminum extrusions.

The invention is additionally of a display screen and enclosure apparatus comprising: a plurality of metal extrusion profiles adhering to predetermined specifications; a plurality of corner metal castings joining the metal extrusion profilesat corners to form a display screen frame; one or more sheet metal back panels enclosing a back of the display screen and enclosure apparatus; and a display screen mounted within the frame. In certain embodiments, the metal extrusion profiles comprise aluminum extrusion profiles. Preferably the invention additionally comprises a glass sheet above the display screen, most preferably with touch sensors bonded to the glass sheet.

The invention is further of a method of manufacturing a display screen (and a display screen thus made), comprising the steps of: providing a plurality of metal extrusion profiles adhering to predetermined specifications; employing a plurality of corner metal castings to join the metal extrusion profiles at corners to form a display screen frame; enclosing a back of the display screen frame with one or more sheet metal back panels; and mounting a display screen within the display screen frame. In certain embodiments, the metal extrusion profiles comprise aluminum extrusion profiles. Preferably the invention additionally comprises a glass sheet above the display screen, most preferably with touch sensors bonded to the glass sheet.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more embodiments of the invention and are not to be construed as limiting the invention. In the drawings.

DETAILED DESCRIPTION OF THE INVENTION

Figure 1:
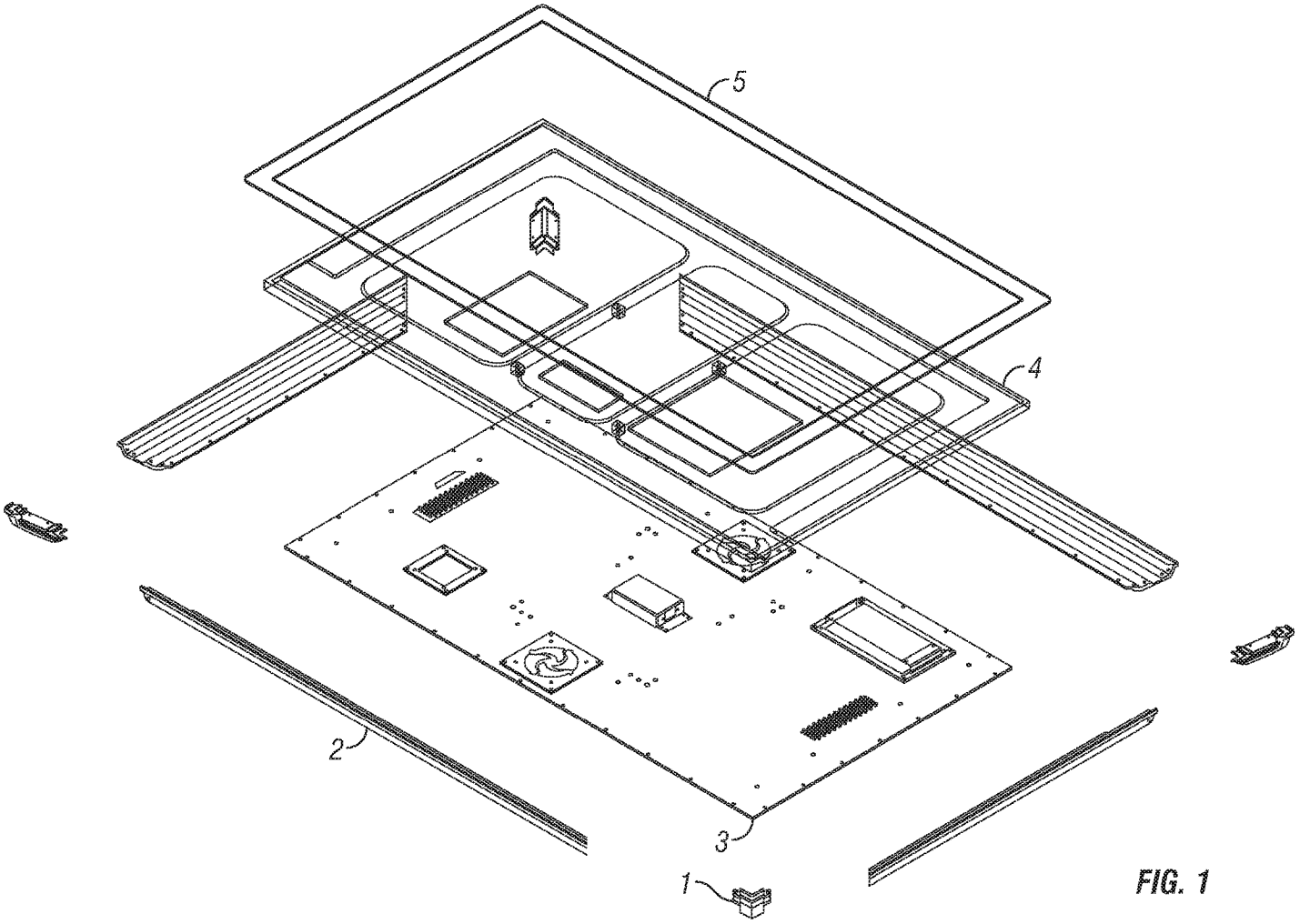
FIG. 1 is an exploded view of the preferred display made according to the invention.
Figure 2A:
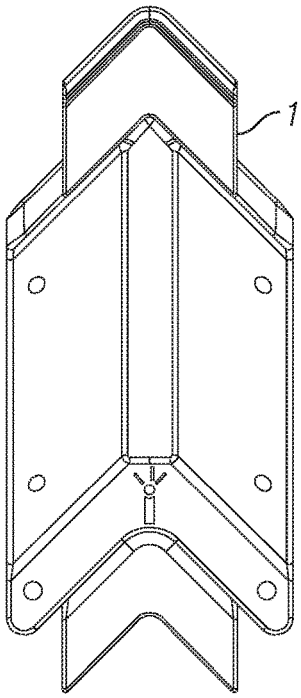
FIGS. 2A-2I show metal castings preferably utilized in the process of the invention.
Figure 2B:
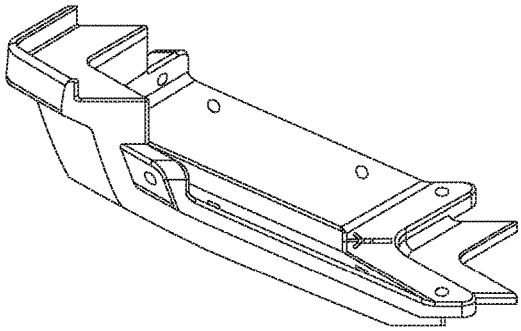
Figure 2C:
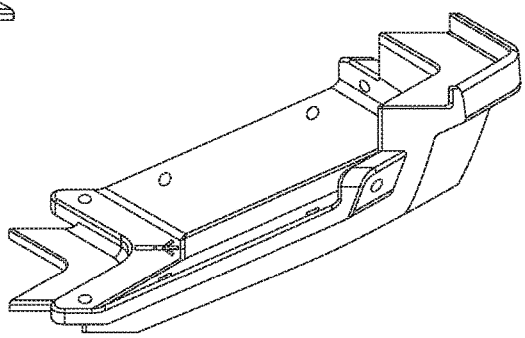
Figure 2D:
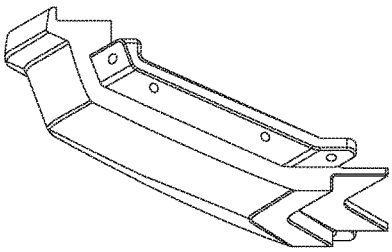
Figure 2E:
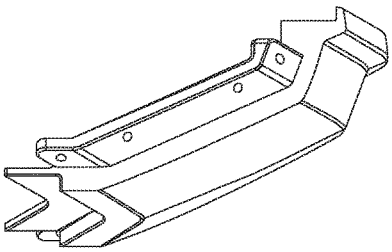
Figure 2F:
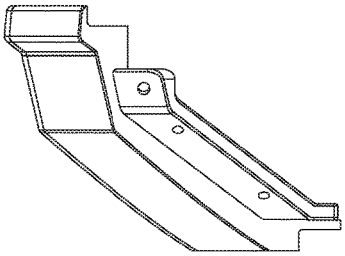
Figure 2G:
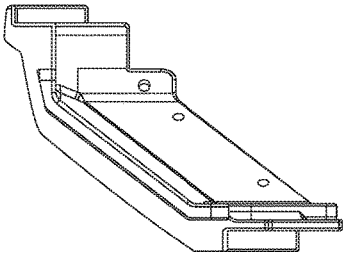
Figure 2H:
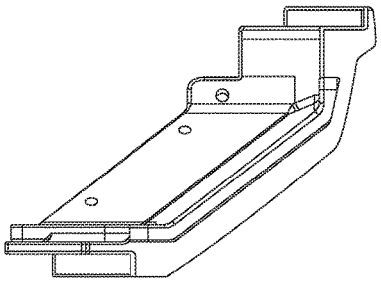
Figure 2I:
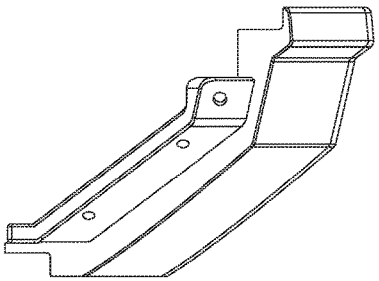
Figure 3A:
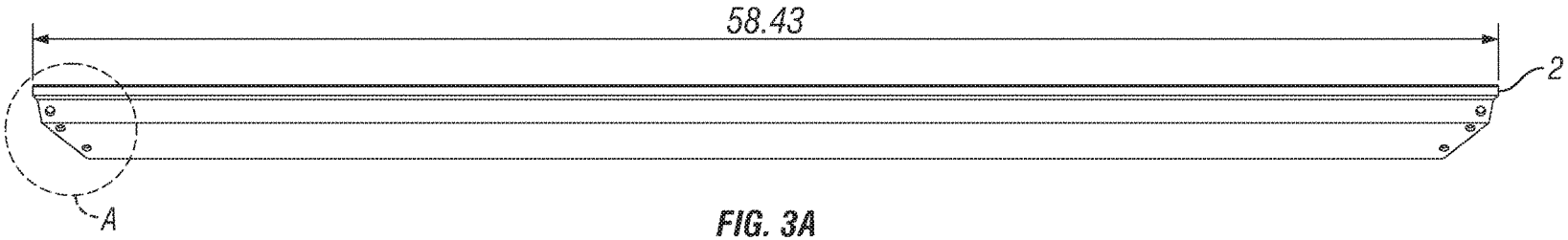
FIGS. 3A-3D show the preferred aluminum extrusion profile used in the process of the invention.
Figure 3B:
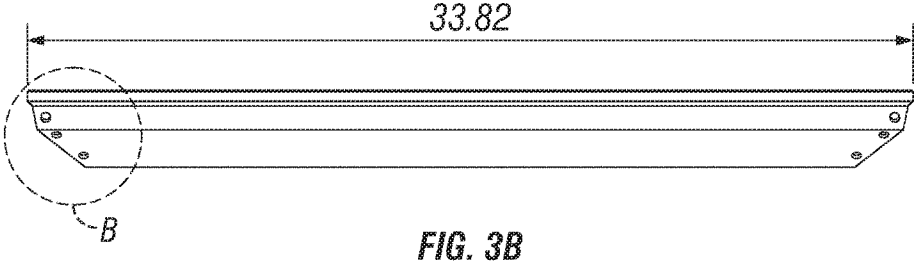
Figure 3C:
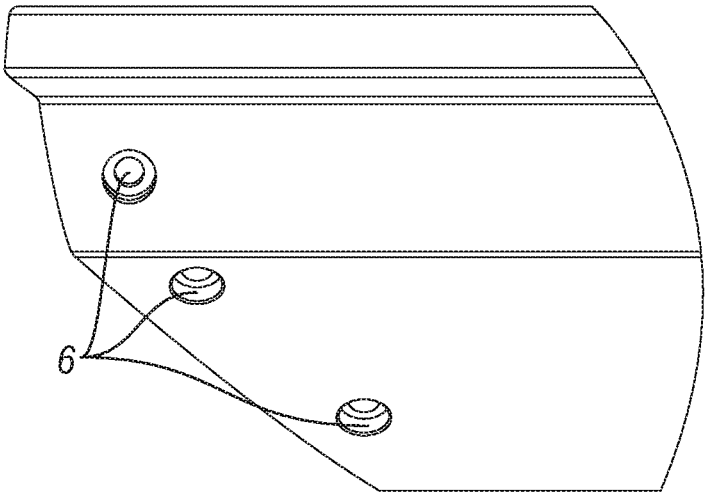
Figure 3D:
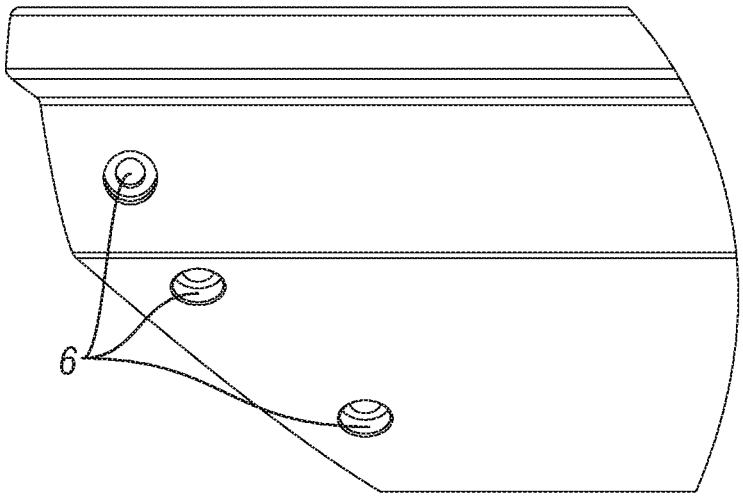

The present invention is of a display enclosure, preferably multi-touch, that is dynamic, scalable and robust, allowing for multiple sizes and designs to be manufactured using a shared set of raw components, and of a corresponding method of manufacturing a screen display. This allows one to dramatically reduce design and engineering workloads during new and revised designs. This also allows one to reduce overall material costs, manufacturing labor costs, manufacturing lead times, and prototyping lead times.

The invention preferably utilizes three basic manufacturing processes for its three core components: Aluminum extrusion, metal casting, and sheet metal fabrication. The connected pieces of extrusion are similar to a picture frame with a strong backing and corner connections. Rather than holding a painting, it is designed to hold an LCD (Liquid Crystal Display) and glass with touch capabilities built in, or other, typically large, type of display screen.

In the aluminum extrusion manufacturing process, long lengths of material are produced with a uniform profile. Common products that use this process are heat sinks, T-slotted structural aluminum parts, and architectural products, e.g., extruded aluminum stairs. Profiles are produced in lengths sometimes exceeding 150 ft., with high precision, excellent straightness and flatness, and with minimal twist along their lengths.

A "die" made from tool steel defines the two-dimensional shape of the profile. The profile is defined by a hole in the body of the tool steel die, in the precise shape of the intended profile. This die can be manufactured using a variety of reductive processes.

Raw aluminum ingots, of the intended alloy, are preheated to a temperature below the melting point. The tool steel die is pre-heated to the same temperature. The aluminum is pressed into the die with many hundreds of tons of force, and combined with heat and pressure the aluminum is malleable enough to be forced through the hole of the profile in the die, producing the intended profile in a length of aluminum.

The resulting aluminum extrusion then goes through a process of stretching, straightening, heat treating, and trimming in order to produce an aluminum extrusion product to the specifications of the customer.

In the aluminum casting manufacturing process, simple and intricate forms and products are produced in a repeatable manner. Common products that use this process are automotive engine blocks, large power tool frames, equipment covers and enclosures, and the internal frames of many consumer electronic devices.

There are many different casting processes, but they all share a few common elements. The product's intended metal alloy is heated beyond its melting point, producing a liquid metal. This metal is poured or mechanically forced into a tool, or mold, which is the negative of the product's intended form. The liquid metal cools inside of the tool, becoming solid, and the tool is either broken apart or disassembled around the solid part. The resulting part often requires some secondary processes to trim, clean and correct the part to meet customer specifications.

In the sheet metal fabrication manufacturing process, simple and intricate forms and products are produced in a manner allowing for either repeatable production or custom one-off results. Common products that use this process are automotive body panels, highway guardrails, and desktop computer cases.

There are many different processes that can be utilized within the scope of sheet metal manufacturing, but they all share a few common elements. The base material is metal that is produced in large, thin sheets. The sheet metal can be bent, formed into complex forms, cut, machined, and bolted or welded together with other metal parts to create the intended customer part. The processes involved can be manual and hand-driven, partially automated, or fully automated to produce fully repeatable parts and components for one-offs or mass production.

The materials preferably used in a multi-touch display enclosure according to the invention are primarily aluminum of varying alloys and tempers. Aluminum is used because of its superior workability and machinability, its light weight, high strength, low susceptibility to corrosion, and recyclability. It readily accepts wet and dry painting processes, as well as a variety of plating and anodizing processes to achieve various surface finishes. Different alloys are chosen due to the availability of alloys commonly used in the aforementioned manufacturing processes, and the properties of these alloys, to support the product's needs for strength, stiffness and weight, and cost effectiveness.

The multi-touch display enclosure design of the invention houses a flat-panel television display, a glass face with a projected-capacitive touch sensor bonded on the underside (or the like, such as infrared (IR) or Fourier Transform Infrared (FTIR) spectroscopy through glass), and various associated components necessary to their operations. The enclosure provides a rugged body that protects the individual components against dirt, dust, liquids, impacts, scratches, and other external forces. The intended use scenario is in public spaces with high user traffic, such as museum spaces, however it is suitable for a wide variety of spaces and use scenarios. The enclosure is designed to be able to withstand years of regular use by the general public, although its use is not limited to environments requiring such ruggedness.

Reference is now made to the figures illustrating the invention. FIG. 1 provides an exploded view of a display made according to the invention, preferably comprising metal castings 1 at corners, aluminum extrusion profiles 2 at the sides, sheet metal back plate 3, flat-panel display 4, and glass 5 with touch sensor bonded to underside.

FIGS. 2A-2I show metal castings preferably utilized in the manufacturing process of the invention. The complexity of the metal cast corner parts is made possible at low cost by casting manufacturing methods. The views shown are as follows: 2A—top-down orthographic view; 2B—left-side top-down orthographic view; 2C—right-side top-down orthographic view: 2D—left-side bottom-up orthographic view; 2E—right-side bottom-up orthographic view; and 2F-2I—orthographic elevation views.

FIGS. 3A-3D show the preferred aluminum extrusion profile used in the manufacturing process of the invention, with exemplary sizing information. This example shows that different designs may use different lengths of material (compare FIGS. 3A and 3B); however, the corner machining details preferably remain the same (compare FIGS. 3C and 3D), e.g., three holes 6, simplifying the manufacturing across a variety of offered products.

Current designs primarily utilize sheet metal fabrication processes to produce their multi-touch display enclosures. While these processes are sometimes scalable for mass manufacturing, they are not always ideal. Many of these processes require manual labor or manual material handling, and are by nature expensive. Labor costs can be reduced, but doing so dramatically increases tooling costs—and often requires new tooling for different sizes or designs of display enclosures. Depending on the level of tooling required and manual labor processes involved, lead time to produce a new product may vary significantly. Sheet metal based designs often cannot go into production without knowing all details of the finished design.

The present invention solves the following problems associated with the commonly used current design:

High manufacturing labor costs;

Long manufacturing lead times;

Long design lead times;

Potentially high tooling costs with high production volumes;

Large space needs during storage of unassembled materials;

Low/no adaptability when using high production tooling; and

High product cost at lower volumes.

The design according to the present invention revolves around three primary components: (1) Aluminum extrusion profiles, cut to length as dictated by the particular product/model design; (2) Metal castings at the corners, which join the aluminum extrusion lengths together to form a frame; and (3) A sheet metal back panel which encloses the back of the product, adds structural rigidity, and provides mounting surfaces for the flat-panel display and other required components. The front of the design is enclosed by the glass touch sensor, which is provided a mounting surface by the aluminum extrusion profiles and the corner metal castings.

This new design solves a number of the aforementioned problems. By utilizing aluminum extrusions, large volumes of material can be produced simultaneously with minimal labor involvement. Finished primary material costs are low, and the tooling cost is extremely low. This material can be ordered in bulk without knowledge of which sizes or models it will be used for.

By utilizing metal castings, the present invention is able to provide a variety of products sharing complex common components that can be made in mass quantities. The casting process has low labor involvement, is highly repeatable, produces an accurate product, and only has moderate initial tooling costs. These cast components can be ordered in bulk without knowledge of which sizes or models it will be used for.

By utilizing a dynamic design that uses these same cast corner parts and the same aluminum extrusion profile, different size enclosures can be produced. The only part that must be designed from scratch for new products is the sheet metal back panel. The aluminum extrusions must only be cut to different lengths, with the corner machining operations remaining the same regardless of length. The metal castings remain unchanged across all model offerings using this core design. Design and manufacturing lead times are dramatically reduced regardless of volume, and the design is highly adaptable.

The only sheet metal manufacturing processes involved in the invention are laser cutting/punching, simple hole machining, and simple bending operations. The back panel may include multiple parts to accommodate the design needs for a particular display. Preferably no welding is used in the invention, although welding could be introduced as needed in larger sizes to add structural rigidity to the back panel. The elimination/reduction of welding operations greatly reduces labor costs, and the processes involved are better suited to automated mass manufacturing, thereby lowering overall costs and manufacturing lead times.

Applicant estimates that the invention provides a reduction in metal manufacturing costs by about 50-80% per product.

Note that in the specification and claims, "about" or "approximately" means within twenty percent (20%) of the numerical amount cited.

Although the invention has been described in detail with particular reference to these embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A method of manufacturing display screen enclosures comprising:

extruding metal to create metal extrusion profiles of the display screen enclosures;

casting metal to create metal castings for corners of the display screen enclosures;

joining the metal castings to the metal extrusion profiles together forming a frame; and fabricating a sheet metal back panel for structural rigidity and to provide a mounting surface within the frame.

2. The method according to claim 1, wherein the cast metal comprises a metal alloy.

3. The method according to claim 2, wherein casting comprises:

heating the metal alloy beyond its melting point, wherein said heating produces a liquid metal;

pouring or mechanically forcing said liquid metal into a tool or a mold, wherein the tool or mold is a negative of an intended form;

cooling the liquid metal inside of the tool or mold until it is a solidified metal;

disassembling the tool or mold around the solidified metal;

adjusting the solidified metal to meet predetermined specifications; and repeating to create a plurality of substantially similar metal castings.

4. The method according to claim 1, wherein the extruded metal comprises aluminum.

5. The method according to claim 4, wherein extruding produces long lengths of material with a uniform profile, and further comprises:

preheating raw aluminum ingots to a temperature below the melting point of the raw aluminum ingots;

preheating a tool die with a hole to the same temperature;

pressing the raw aluminum ingots into the tool die with a predetermined force, wherein temperature and pressure makes the raw aluminum ingots malleable;

forcing the raw aluminum ingots through the hole of the tool die;

producing the profile in a length of aluminum, wherein the profile is a uniform aluminum extrusion profile;

adjusting the aluminum until the aluminum extrusion meets predetermined product specifications; and repeating to create a plurality of substantially similar aluminum extrusions.

6. The method according to claim 5, wherein the profiles are substantially straight.

7. A display screen enclosure comprising:

metal extrusions;

cast metal corners, said cast metal corners joined to said metal extrusions to form a frame; and a back panel formed from sheet metal, said back panel configured to provide a mounting surface within said frame.

8. A display screen and enclosure apparatus comprising:

a plurality of metal extrusion profiles adhering to predetermined specifications;

a plurality of corner metal castings joining said metal extrusion profiles at corners to form a display screen frame;

one or more sheet metal back panels enclosing a back of said display screen and enclosure apparatus; and a display screen mounted within said frame.

9. The apparatus according to claim 8, wherein said metal extrusion profiles comprise aluminum extrusion profiles.

10. The apparatus according to claim 8, additionally comprising a glass sheet above said display screen.

11. The apparatus according to claim 10, additionally comprising touch sensors bonded to said glass sheet.

12. A method of manufacturing a display screen comprising:

providing a plurality of metal extrusion profiles adhering to predetermined specifications;

employing a plurality of corner metal castings to join the metal extrusion profiles at corners to form a display screen frame;

enclosing a back of the display screen frame with one or more sheet metal back panels; and mounting a display screen within the display screen frame.

13. The method according to claim 12, wherein the metal extrusion profiles comprise aluminum extrusion profiles.

14. The method according to claim 12, additionally comprising placing a glass sheet above the display screen.

15. The method according to claim 14, wherein the glass sheet comprises touch sensors bonded thereto.

16. A display comprising:

a plurality of metal extrusions;

a plurality of corner metal castings;

a display screen frame, said display screen frame comprising said plurality of metal extrusions joined by said plurality of corner metal castings;

one or more sheet metal back panels positioned to enclose a back of said display screen; and a display screen disposed within said display screen frame.

17. The display screen enclosure of claim 7 further comprising a glass screen disposed therein.

18. The display screen enclosure of claim 17 wherein said glass screen comprises a touch screen comprising a touch sensor bonded to an underside of said glass screen.

19. The display of claim 16 wherein said display screen comprises a glass screen.

20. The display of claim 19 wherein said glass screen comprises a touch screen comprising a touch sensor bonded to an underside of said glass screen.

* * * * *